United States Patent [19]

Strandli et al.

[11] Patent Number: 4,876,964

[45] Date of Patent: Oct. 31, 1989

[54] PROJECTILE AND METHOD OF MAKING IT

[75] Inventors: Kare R. Strandli; Svein T. Halvorsen, both of Raufoss, Norway

[73] Assignee: Raufoss A/S, Raufoss, Norway

[21] Appl. No.: 224,244

[22] Filed: Jul. 25, 1988

Related U.S. Application Data

[63] Continuation of Ser. No. 54,787, May 25, 1987, abandoned.

[30] Foreign Application Priority Data

May 29, 1986 [NO] Norway ..... 862128

[51] Int. Cl.[4] ..... F42B 13/12

[52] U.S. Cl. ..... 102/499; 102/204; 102/272; 102/364; 102/479

[58] Field of Search ..... 102/364, 365, 204, 205, 102/202.1, 272, 273, 479, 499, 500, 487, 488, 702; 86/20.14; 29/1.2–1.23

[56] References Cited

U.S. PATENT DOCUMENTS

| | | | |
|---|---|---|---|
| 1,380,773 | 6/1921 | Clay . | |
| 2,363,024 | 11/1944 | Thibodeau | 102/500 |
| 2,373,883 | 4/1945 | Ferrel | 102/499 |
| 2,424,970 | 8/1947 | Church et al. | 102/56 |
| 2,532,323 | 12/1950 | Miller, Jr. | 102/364 |
| 2,764,092 | 9/1956 | Massey | 102/73 |
| 3,013,495 | 12/1961 | Stevenson et al. . | |
| 4,480,551 | 11/1984 | LoFiego | 102/245 |
| 4,615,272 | 10/1986 | Aubert | 102/479 |

FOREIGN PATENT DOCUMENTS

| | | | |
|---|---|---|---|
| 2552950 | 6/1977 | Fed. Rep. of Germany . | |
| 654406 | 2/1986 | Switzerland | 102/364 |
| 654406 A5 | 2/1986 | Switzerland . | |
| 417314 | 10/1934 | United Kingdom . | |
| 1223931 | 3/1971 | United Kingdom . | |
| 1507119 | 4/1978 | United Kingdom . | |

OTHER PUBLICATIONS

"Ammunition" (Including mines and grenades), K. J. W. Goad and D. H. J. Halsey, Brassey's Battlefield and Weapon Systems and Technology, Col. 111, 1982, pp. 116–117.

*Primary Examiner*—Harold J. Tudor
*Attorney, Agent, or Firm*—Bacon & Thomas

[57] ABSTRACT

A projectile and method of making it having a forward end portion which comprises a hollow, metallic nose portion (1) containing a charge (3) adapted to detonate by impact against a target without the use of a fuse. In order to achieve safeguard against initiation when the impact velocity is low the cavity in the nose portion, in a distance from the forwardmost part thereof, is covered by a liner (4) of a softer material than the metal of the nose portion. The liner may be of plastic material.

7 Claims, 1 Drawing Sheet

PROJECTILE AND METHOD OF MAKING IT

This application is a continuation of U.S. patent application Ser. No. 054,787 filed May 25, 1987, now abandoned.

BACKGROUND OF THE INVENTION

The present invention relates to a projectile having a forward end portion which comprises a hollow, metallic nose portion, the nose portion containing a charge adapted to detonate by impact against a target without the use of a fuse. In such projectiles, the charge in the nose portion, usually a sensitive incendiary charge, acts to ignite a pyrotechnical chain in the projectile, which may contain one or more additional charges in the form of incendiary charges and/or explosive charges. The charge in the nose portion has been pressed into and fills the cavity in the nose portion all the way to the forward end thereof.

When such a projectile hits a target, the nose portion is deformed by being clenched. This causes the charge to be ignited because of the violent mechanical strain. Thus, the pyrotechnical chain is initiated and all the charges in the projectile are converted.

There is, however, a possibility of inadvertent initiation, such as when the tip of the nose portion during handling of the projectile hits a hard surface. It is possible to prevent complete conversion after such initiation by installing a mechanical safety device which prevents propagation of the pyrotechnical chain rearwardly, but such devices have been found to be unacceptibly expensive, in particular for small calibers.

The use of a liner inside of the nose portion of a projectile is per se known. For instance the German Accessibility Print 2552950 describes the use of a bitumen layer which cover the entire inner surface of a nose portion of a projectile, for the purpose of mutually protecting the charge and the nose portion against mutually injurious influence. Moreover the bitumen layer provides good adhesion between the charge and the inner surface of the nose portion. The prior art projectile, however, comprises a fuse (base fuse), and the charge in the nose portion is not adapted to and not able to initiate by itself upon impact in a target. The charge (incendiary charge) will be ignited upon initiation of an explosive charge situated rearwardly of it.

SUMMARY OF THE INVENTION

The object of the present invention is to achieve a projectile which is safeguarded against inadvertent initiation while maintaining its functional ability by impact in a target when being fired.

The projectile of the type which the present invention relates to, i.e. a projectile without any fuse and being based on initiation by deformation of the nose portion and a violent mechanical clenching of an incendiary charge therein, has a relatively soft inner liner in the nose portion, covering also the forwardmost part thereof, no ignition will take place. The deformation of the nose portion will not cause the neccessary mechanical clenching needed to cause ignition or initiation. Important features of the present invention are that the charge inside the nose portion is adapted to cause initiation by impact against a target upon launching of the projectile, and that the layer inside the nose portion does not cover the forwardmost part of the cavity therein.

The reason why a safeguarding against initiation by an inadvertent impact against the tip of the nose portion during handling is achieved can be explained in the following manner.

When the projectile hits a target upon launching, a very violent impact against the tip of the nose portion takes place, and the forwardmost charge in the nose portion ignites, because the impact velocity is high.

When, to the contrary, the projectile is exposed to a high energy impact of low velocity against the tip of the nose portion and the charge therein, as for instance if the projectile falls against a surface during handling, a substantially larger deformation is neccessary in order to cause initiation, and a pinching takes place in a certain distance from the tip, in the region where the liner is situated.

Thus, the pinching takes place with the liner forming a damper between the charge and the metal of the nose portion, whereby ignition is avoided. In other words the liner acts as a phlegmatizer. The effect may be considered to correspond to covering the strike surface of a matchbox with wax.

When the deformations are very large but take place with a substantially lower velocity compared with the impact in a target upon launching, the liner will be partly mixed with the charge in the boundary zones between the charge and the metal of the nose portion. This has a phlegmatizing effect on the charge, and the sensitivity to impacts will be significantly reduced.

Drop tests have shown a significantly increased safeguard, in such a manner that the drop height can be substantially increased without the occurrence of ignition, compared with projectiles without an inner liner in the nose portion.

BRIEF DESCRIPTION OF THE DRAWINGS

The invention will in the following be explained more detailed with reference to the accompanying drawings.

DETAILED DESCRIPTION OF THE INVENTION

Figure 1:
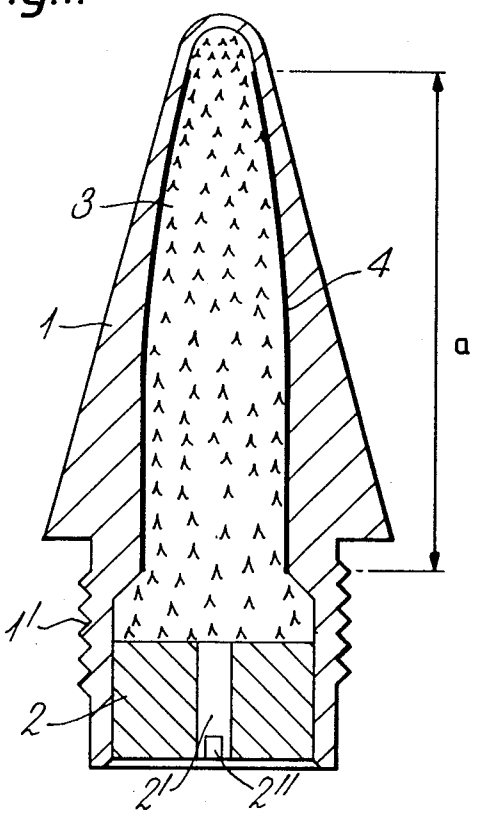
FIG. 1 shows a finished end portion in accordance with the invention.

The forward end portion shown in FIG. 1 comprises a hollow metallic nose portion 1. The nose portion 1 contains a pyrotechnical charge 3 adapted to ignite and burn upon impact in a target. Rearwardmost, the nose portion is partly closed by a disc 2, which during launching prevents parts of the charge 3 from being forced rearwardly due to the acceleration of the projectile. The disc 2 has an axial, through-going aperture 2', through which burning gas from the charge 3 can flow in order to ignite the charge more rearwardly in the projectile upon impact in a target. The disc 2 may be screwed into the nose portion 1, and it may have a groove 2'' for a screwdriver. Internally the nose portion 1 has a liner comprising a coating 4 starting at a certain distance from the tip. The liner 4 may for instance have the length a indicated in FIG. 1. The material of the liner is softer than the metal of the nose portion, and may be of a plastic material.

The nose portion has outer threads 1', in order to be screwed into the forward end of a projectile shell (not shown).

When a projectile equipped with a forward end portion shown in FIG. 1 hits a target with a normal impact velocity the charge 3 will ignite and the projectile will function in a normal manner.

Figure 2:
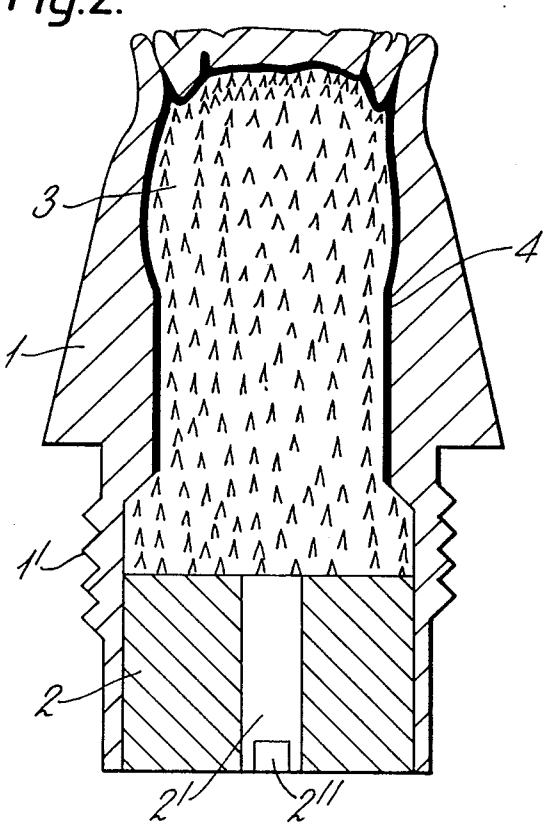
FIG. 2 shows an end portion in accordance with the invention after a drop test from a height of 15 m.

If, however, the projectile is exposed to a blow against the nose portion and the impact velocity is substantially lower, the end portion may be deformed to the shape shown in FIG. 2 without ignition of the charge 3. Such a deformation may for instance occur in a drop test, i.e. that the projectile falls with the forward end portion in a downward direction and hits a hard surface. Such tests are used in order to find out how safe the handling of the projectile is. The height from which the projectile can be dropped without ignition of the charge 3 is a safety measure.

Drop tests may also be carried out by dropping the forward end portion from one single height and by varying the mass behind the end portion. In this case the mass will be a safety measure.

What happens in a forward end portion without an inner liner when dropped in a drop test is that parts of the charge are pinched between metal surfaces inside the nose portion. At a certain drop height the pinching will cause sufficient friction against the charge to cause ignition of the charge.

In a projectile in accordance with the invention, when dropped from a drop height which would cause ignition in an end portion without an inner liner, the liner 4 will act as a damper and reduce the friction, and the charge 3 will not ignite. The liner 4 may also be mixed together with the charge 3 in the pinching zones (see FIG. 2) and thereby phlegmatize the charge.

Tests have shown that a forward end portion adapted for a projectile of caliber 40 mm may be dropped from a height of 15 m together with a mass of up to four (4) times the mass of a complete projectile without ignition taking place.

A test made for comparison has shown that ignition takes place in a forward end portion without an inner liner when dropped from a height of 15 m together with a mass of 1.5 times the mass of a complete projectile.

When a projectile according to the invention hits a target with normal impact velocity the charge 3 will ignite despite the presence of the liner 4. The deformation will be so violent that the liner 4 will not have the effect of preventing ignition.

The use of a charge 3 in the nose portion without any fuse mechanism is of course made on the condition that the charge is sufficiently sensitive. This principle is, however, known and has proved reliable, and the choice of adequate sensitivity lies within the skill of persons skilled in the art. Therefore, a closer specification of suitable charges is not given here.

The liner 4 may be a varnish or a plastic material, and may advantageous be rapidly hardening. The latter makes it easier to apply the liner, such as by spraying without the risk that the liner material flows after having been applied.

We claim:

1. A projectile comprising:

(a) a metallic nose portion having an inner wall defining an interior cavity with a closed forward end portion;

(b) an impact detonatable charge filling the cavity and extending into the forward end portion; and (c) a coating formed of a material that is softer than the metal forming the nose portion applied to the inner wall so as to substantially cover the entire inner wall between the nose portion and the charge except for the closed forward end portion so as to prevent detonation of the charge cuased by low velocity impact deformation of the nose portion.

2. The projectile of claim 1 wherein the coating is formed of plastic material.

3. The projectile of claim 1 wherein the coating extends rearwardly to substantially the rearward end of the cavity.

4. The projectile of claim 1 wherein the coating is formed of a rapidly hardenable plastic material.

5. A method of making a projectile having reduced detonation on low velocity impact comprising the steps of:

(a) forming a nose portion of metal having an inner wall defining an interior cavity with a closed forward end portion;

(b) applying a coating to the inner wall so as to substantially cover the entire inner wall except for the closed forward end portion, the coating comprising a material softer than the metal forming the nose portion; and, (c) filling the interior cavity with an impact detonatable charge such that the charge extends into the closed forward end portion.

6. The method according to claim 5 wherein the step of applying a coating to the inner wall comprises applying a coating of plastic material.

7. The method according to claim 6 wherein the plastic material comprises a rapidly hardenable plastic material.

* * * * *